US008785368B2

(12) United States Patent
Nishina et al.

(10) Patent No.: US 8,785,368 B2
(45) Date of Patent: Jul. 22, 2014

(54) SOLID SOAP COMPRISING TRIMETHYLGLYCINE

(71) Applicant: P & PF Co., Ltd., Ibaraki (JP)

(72) Inventors: Tetsuo Nishina, Takatsuki (JP); Takahito Makita, Ibaraki (JP); Tomoko Toda, Sakai (JP); Takahiro Okuda, Machida (JP); Yoshinobu Saito, Ibaraki (JP)

(73) Assignee: P & PF Co., Ltd., Ibaraki-shi, Osaka (JP)

( * ) Notice: Subject to any disclaimer, the term of this patent is extended or adjusted under 35 U.S.C. 154(b) by 0 days.

(21) Appl. No.: 13/802,983

(22) Filed: Mar. 14, 2013

(65) Prior Publication Data

US 2013/0244923 A1 Sep. 19, 2013

(30) Foreign Application Priority Data

Mar. 16, 2012 (JP) ..... 2012-059682

(51) Int. Cl.
*C11D 9/00* (2006.01)

(52) U.S. Cl.
USPC ..... 510/481; 510/129; 510/130; 510/141; 510/152; 510/316; 510/343; 510/353; 510/389; 510/399; 510/430; 510/490

(58) Field of Classification Search
USPC ..... 510/129, 130, 141, 152, 316, 343, 353, 510/389, 399, 430, 481, 490
See application file for complete search history.

(56) References Cited

U.S. PATENT DOCUMENTS

| | | | | |
|---|---|---|---|---|
| 5,340,492 | A * | 8/1994 | Kacher et al. | 510/146 |
| 6,297,205 | B1 | 10/2001 | Saxena et al. | |
| 6,491,933 | B2 * | 12/2002 | Lorenzi et al. | 424/401 |
| 2007/0196313 | A1 * | 8/2007 | Scala et al. | 424/70.13 |
| 2010/0317555 | A1 * | 12/2010 | Araki et al. | 510/122 |

FOREIGN PATENT DOCUMENTS

| | | |
|---|---|---|
| JP | 2001-40390 | 2/2001 |
| WO | 95/26710 | 10/1995 |
| WO | 2004/029190 | 4/2004 |

OTHER PUBLICATIONS

European Search Report dated Jun. 21, 2013, Application No. 13159378.2, 6 pages.
Patent Abstracts of Japan, Publication No. JP 2001-40390, 9 pages.
Espacenet English Abstract of WO 2004/029190, 1 page.

* cited by examiner

*Primary Examiner* — Charles Boyer
(74) *Attorney, Agent, or Firm* — Rankin, Hill & Clark LLP

(57) ABSTRACT

The object of the present invention is to improve the solidification point and the hardness of a soap of the fatty acid soap series wherein a large amount of myristic acid is blended. The solid soap of the present invention to achieve the above-described object is characterized by comprising a fatty acid soap and 1 to 8 mass % of betaine, and in that the content of myristic acid is 50 mass % or more in the total fatty acid of the fatty acid soap.

5 Claims, No Drawings

SOLID SOAP COMPRISING TRIMETHYLGLYCINE

RELATED APPLICATIONS

This application claims the priority of Japanese Patent Application No. 2012-59682 filed on Mar. 16, 2012, which is incorporated herein by reference.

FIELD OF THE INVENTION

The present invention relates to a solid soap, and in particular, relates to the improvement in solidification of a solid soap wherein myristic acid soap is the main component.

BACKGROUND OF THE INVENTION

Common solid soaps are normally produced by a framing method or a milling method by using fatty acid soap as the base and by adding sugars or polyols such as sucrose, glycerin, sorbitol, and propylene glycol as necessary.

The fatty acid composition has a major effect on the properties of soap. If a saturated higher fatty acid (C18 stearic acid etc.) having a high number of carbon atoms is used, the solidification point and the hardness normally increase, and the adjustment of the shape of solid soap is easy. However, the solubility and the foaming property in cold water decrease, and they tend to decrease the cleansing power and the feeling in use. On the other hand, if a large amount of C12 lauric acid, C14 myristic acid, etc. (hereinafter referred to as "medium-chain fatty acid") is used as the fatty acid, the solubility and the foaming property in cold water are largely improved. However, the solidification point and the hardness significantly decrease, and production suitability as solid soap and the shape-retaining property deteriorate. In particular, C14 myristic acid is excellent in the cleansing property and low-irritability, and it is desired to be used as the main component of solid soap. However, if the amount exceeds 50 mass % in the total fatty acid, the solidification point and the hardness tend to decrease notably. Thus, when myristic acid is used in a solid soap, the content of about 50% thereof has virtually been the limit.

Especially in the case of transparent soap, it is necessary to add a substantial amount of sugars or polyols to achieve transparency. Thus, the decrease in the solidification point is large, and the use of a large amount of medium-chain fatty acids tends to be difficult.

That is, the structural mechanism of letting transparent soap be transparent is considered that opaque soap fibrous microcrystals, which are optically discontinuous in size with respect to visible light, are mainly severed perpendicularly to the fiber axes by the addition of the above-described sugars and polyols and refined to the size of a wavelength of visible light or less; as a result, the soap becomes transparent. Therefore, the hardness and the solidification point easily decrease compared with the soap in which sugars and polyols are not added.

In particular, when transparent soap is produced by the framing method without using ethanol as the solvent for sugars and polyols, cutting, shape forming, and packaging are often carried out immediately after the removal of the frame. Thus, the decrease in the solidification point and the decrease in the hardness also directly lead to the deterioration of production suitability.

Therefore, the use of a large amount of myristic acid, which tends to lower the hardness and solidification point, has been difficult.

On the other hand, soaps in which amino acids or trimethylglycine is blended are publicly known (Japanese Unexamined Patent Publication No. 2001-40390 and WO2004/029190); however, the presence of adjustment effects for the decrease of the solidification point and the hardness, when a large amount of myristic acid is blended, has been totally unknown.

DISCLOSURE OF THE INVENTION

Problem to be Solved by the Invention

The present invention was made in view of the above-described conventional art, and the problem to be solved is to provide a solid soap that can improve the solidification point and the hardness while achieving the characteristics such as the solubility in cold water and the feeling in use even when a large amount of medium-chain fatty acid is used as the fatty acid.

Means to Solve the Problem

In order to achieve the above-described object, the present inventors have investigated the means for increasing the solidification point of fatty acid soap. As a result, the present inventors have discovered that betaines, and in particular, trimethylglycine has an excellent solidification point increasing effect, thus leading to the completion of the present invention.

The solid soap of the present invention, to achieve the above-described object, is characterized by comprising a fatty acid soap, and 1 to 8 mass % of betaine, and in that the content of myristic acid is 50 mass % or more in the total fatty acid of the fatty acid soap.

In the above-described solid soap, it is preferable that a mole ratio of sodium/potassium is from 80/20 to 50/50, and 1 to 5 mass % of trimethylglycine is blended as the betaine.

In addition, it is preferable that the above-described solid soap comprises 20 to 70 mass % of a fatty acid soap part and 30 to 70 mass % of a sugar/polyol part, and it is transparent solid soap in which no ethanol is virtually contained.

Hereinafter, the constitution of the present invention will be described in detail.

[Fatty Acid Soap Part]

The fatty acid in the fatty acid sodium salt or fatty acid sodium/potassium mixed salt used in the soap of the present invention is a saturated or unsaturated fatty acid wherein the number of carbon atoms is preferably 8 to 20 and more preferably 12 to 18, and it may be either linear or branched. Specific examples include laurie acid, myristic acid, palmitic acid, stearic acid, oleic acid, isostearic acid, and mixtures thereof, namely beef tallow fatty acid, coconut oil fatty acid, and palm kernel oil fatty acid. In the present invention, among these fatty acids, 50 mass % or more of C12 and C14 medium-chain fatty acids, and specifically myristic acid, are contained in the fatty acids. More preferably, when 70 mass % or more of myristic acid is contained, the prominent effect of the present invention can be achieved. When the content is 50 mass % or less, a significant improvement in foam volume and foam property, which are the addition effect of myristic acid, may not be achieved.

Specific examples of the fatty acid sodium/potassium mixed salts include sodium/potassium laurate, sodium/potassium myristate, sodium/potassium palmitate, sodium/potassium stearate, sodium/potassium oleate, sodium/potassium isostearate, beef tallow fatty acid sodium/potassium salt, coconut oil fatty acid sodium/potassium salt, and palm kernel oil fatty acid sodium/potassium salt, and these may be used either alone or in combination of two or more. Among the above-described fatty acid sodium/potassium mixed salts, sodium/potassium myristate can be preferably used.

In the soap of the present invention, the content of fatty acid sodium salt or fatty acid sodium/potassium mixed salt is preferably 20 to 70 mass % in the case of transparent soap. If this content is less than 20 mass %, the transparency decreases or the solidification point decreases. Therefore, when stored for a long period of time, the surface may melt and the commercial value may be lost. On the contrary, if the content exceeds 70 mass %, the transparency may also decrease, and a taut feeling may be generated after use.

In the fatty acid sodium/potassium mixed salt, the mole ratio of sodium and potassium (sodium/potassium ratio), which constitute the salt, is preferably 100/0 to 40/60 and especially preferably 80/20 to 60/40. If this sodium/potassium ratio exceeds 40/60 and the percentage of potassium becomes large, a satisfactory solidification point cannot be obtained even by the addition of betaine. When stored for a long period of time, the surface may melt and the commercial value may be lost. In addition, the hardness may decrease, the soap reduction through dissolution during use may become large, soap sweating may be caused under the conditions of high temperature and high humidity, and the surface may become cloudy during use.

[Sugar/Polyol Part]

Preferable sugar/polyol examples, when the present invention is used for transparent solid soap, include maltitol, sorbitol, glycerin, 1,3-butylene glycol, propylene glycol, polyethylene glycol, sugar, pyrrolidone carboxylic acid, sodium pyrrolidone carboxylate, hyaluronic acid, and polyoxyethylene alkyl glucoside ether, and it is preferable to blend 30 to 70 mass % thereof in the composition.

In particular, to obtain transparency as well as excellent usability, the ratio of sugars/sugar alcohols and polyols is preferably 40 to 60:60 to 40 in the sugar/polyol part.

[Amphoteric Surfactants]

It is preferable that the solid soap of the present invention contains the following amphoteric surfactant.

As the amphoteric surfactant usable in the solid soap of the present invention, amphoteric surfactants represented by the following chemical formulas (A) to (C) can be listed.

(A)

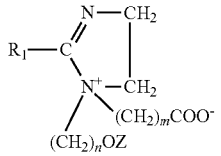

[In the formula, $R_1$ represents an alkyl group or an alkenyl group of 7 to 21 carbon atoms, n and m are the same or different from each other and represent an integer of 1 to 3, and Z represents a hydrogen atom or $(CH_2)_pCOOY$ (here, p is an integer of 1 to 3, and Y is an alkali metal, an alkaline earth metal, or an organic amine).], (B)

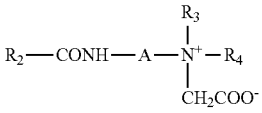

[In the formula, $R_2$ represents an alkyl group or an alkenyl group of 7 to 21 carbon atoms, $R_3$ and $R_4$ are the same or different from each other and represents a lower alkyl group, and A represents a lower alkylene group.], and (C)

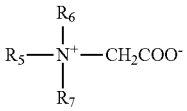

[In the formula, $R_5$ represents an alkyl group or an alkenyl group of 8 to 22 carbon atoms, $R_6$ and $R_7$ are the same or different from each other and represent a lower alkyl group.].

In chemical formula (A), "an alkyl group of 7 to 21 carbon atoms" represented by $R_1$ can be either linear or branched, and the number of carbon atoms is preferably 7 to 17. "An alkenyl group of 7 to 21 carbon atoms" represented by $R_1$ can be either linear or branched, and the number of carbon atoms is preferably 7 to 17. As "an alkali metal" represented by Y, sodium, potassium, etc. can be listed, as "an alkaline earth metal", calcium, magnesium, etc. can be listed, and as "an organic amine", monoethanolamine, diethanolamine, triethanolamine, etc. can be listed.

Specific examples of amphoteric surfactants represented by chemical formula (A) include imidazolinium betaine-type surfactants such as 2-undecyl-N-carboxymethyl-N-hydroxyethylimidazolium betaine (synthesized from lauric acid; hereinafter, for convenience, also referred to as "lauroyl imidazolinium betaine"), 2-heptadecyl-N-carboxymethyl-N-hydroxyethylimidazolium betaine (synthesized from stearic acid), and 2-alkyl or alkenyl-N-carboxymethyl-N-hydroxyethylimidazolium betaine synthesized from coconut oil fatty acid ($R_1$ is a mixture of $C_7$ to $C_{17}$; hereinafter, for convenience, also referred to as "cocoyl imidazolinium betaine").

In chemical formula (B), "an alkyl group of 7 to 21 carbon atoms" and "an alkenyl group of 7 to 21 carbon atoms" represented by $R_2$ are similar to those represented by $R_1$ of chemical formula (A). "A lower alkyl group" represented by $R_3$ and $R_4$ is linear or branched and preferably an alkyl group of 1 to 3 carbon atoms. "A lower alkylene group" represented by A is linear or branched and preferably an alkylene group of 3 to 5 carbon atoms.

Specific examples of amphoteric surfactants represented by chemical formula (B) (amidoalkyl betaine-type) include amidopropyl betaine-type surfactants such as coconut oil fatty acid amidopropyldimethylaminoacetic acid betaine ($R_2$ is a mixture of $C_7$ to $C_{17}$).

In chemical formula (C), "an alkyl group of 8 to 22 carbon atoms" represented by $R_5$ can be either linear or branched, and the number of carbon atoms is preferably 8 to 18. "An alkenyl group of 8 to 22 carbon atoms" represented by $R_5$ can be either linear or branched, and the number of carbon atoms is preferably 8 to 18. "A lower alkyl group" represented by $R_6$ and $R_7$ is similar to the one represented by $R_3$ and $R_4$ of chemical formula (B).

Specific examples of amphoteric surfactants (alkyl betaine-type) represented by chemical formula (C) include lauryldimethylaminoacetic acid betaine and alkyl or alkenyldimethylaminoacetic acid betaine ($R_5$ is a mixture of $C_8$ to $C_{18}$) synthesized from coconut oil fatty acid.

In the present invention, at least one surfactant is selected for use from the group consisting of amphoteric surfactants represented by the above-described chemical formulas (A) to (C). Among these (A) to (C), alkyl betaine-type amphoteric surfactants represented by chemical formula (C) are especially preferable. When a plurality of amphoteric surfactants are used, a plurality of amphoteric surfactants represented by the above-described chemical formula (A) may be used, a plurality of amphoteric surfactants represented by the above-described chemical formula (B) may be used, or a plurality of amphoteric surfactants represented by the above-described chemical formula (C) may be used; however, it is preferable to allow an imidazolinium betaine-type amphoteric surfactant to be essential.

In the solid soap of the present invention, when the above-described amphoteric surfactant is blended, the fatty acid soap (fatty acid sodium salt or fatty acid sodium/potassium mixed salt) and the amphoteric surfactant form a composite salt. Thus, the usability such as "a coarse feeling" is improved and the hardness is also improved; as a result, the effect such as the lowering of soap reduction through dissolution can be achieved.

In the solid soap of the present invention, the content of the above-described amphoteric surfactant is preferably 1 to 15 mass %, and especially preferably 4 to 8 mass %. If this content is less than 1 mass %, the solidification point becomes low.

Thus, when stored for a long period of time, the surface may melt and the commercial value may be lost. In addition, the hardness may decrease, and the soap reduction through dissolution during use may become large. In addition, the transparency may decrease. On the contrary, if the content exceeds 15 mass %, a sticky feeling is generated after use. In addition, when stored for a long period of time, the surface changes to brown and the commercial value may be lost.

[Nonionic Surfactants]

It is preferable to further blend a nonionic surfactant to the solid soap of the present invention. Examples of usable nonionic surfactants include polyoxyethylene (hereinafter also referred to as "POE") hydrogenated castor oil, polyoxyethylene 2-octyldodecyl ether, polyoxyethylene lauryl ether, propylene oxide/ethylene oxide block copolymer, polyoxyethylene polyoxypropylene cetyl ether, polyoxyethylene polyoxypropylene glycol, polyethylene glycol diisostearate, alkyl glucoside, polyoxyethylene-modified silicone (for example, polyoxyethylene alkyl-modified dimethylsilicone), polyoxyethylene-glycerin monostearate, and polyoxyethylene alkyl glucoside. These may be used either alone or in combination of two or more. Among the above-described nonionic surfactants, polyoxyethylene hydrogenated castor oil and propylene oxide/ethylene oxide block copolymer are preferably used.

In the solid soap of the present invention, a more usability improving effect can be achieved by blending a nonionic surfactant.

The content of a nonionic surfactant in the solid soap of the present invention is preferably 1 to 15 mass %, and especially preferably 6 to 12 mass %. If this content is less than 1 mass %, a taut feeling may be generated after use. On the contrary, if the content exceeds 15 mass %, the solidification point decreases. Thus, when stored for a long period of time, the surface may melt and the commercial value may be lost. In addition, the hardness may decrease, and the soap reduction through dissolution during use may become large. In addition, a sticky feeling may be generated after use.

[Hydroxyalkyl Ether Carboxylic Acid Salt-type Surfactants]

It is preferable to add a hydroxyalkyl ether carboxylic acid salt-type surfactant to the solid soap of the present invention; then the improvement in foaming can be observed.

The preferable hydroxyalkyl ether carboxylic acid salt-type surfactant, in the present invention, has the following structure (D).

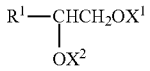

(D)

(In the formula, $R^1$ represents a saturated or unsaturated hydrocarbon group of 4 to 34 carbon atoms; either one of $X^1$ and $X^2$ represents —$CH_2COOM^1$, and the other one represents a hydrogen atom; and $M^1$ represents a hydrogen atom, an alkali metal, an alkaline earth metal, ammonium, a lower alkanol amine cation, a lower alkyl-amine cation, or a basic amino acid cation.)

In the formula, $R^1$ is either an aromatic hydrocarbon or a linear or branched aliphatic hydrocarbon; however, an aliphatic hydrocarbon, especially an alkyl group or an alkenyl group is preferable. Preferable examples include a butyl group, an octyl group, a decyl group, a dodecyl group, a tetradecyl group, a hexadecyl group, an octadecyl group, a docosyl group, a 2-ethylhexyl group, a 2-hexyldecyl group, a 2-octylundecyl group, a 2-decyltetradecyl group, a 2-undecylhexadecyl group, a decenyl group, a dodecenyl group, a tetradecenyl group, and a hexadecenyl group. Among them, a decyl group and a dodecyl group have advantage in the surface-active power.

In the formula, either one of $X^1$ and $X^2$ is represented by —$CH_2COOM^1$, and the examples of $M^1$ include a hydrogen atom, lithium, potassium, sodium, calcium, magnesium, ammonium, monoethanolamine, diethanolamine, and triethanolamine.

Specifically, among the above-described (D) hydroxyalkyl ether carboxylic acid salt-type surfactants, sodium dodecane-1,2-diol acetate ether, in which H of either of the OH groups of dodecane-1,2-diol is replaced with —$CH_2COONa$, is most preferable in the present invention.

In the present invention, 1 to 15 mass % and preferably 5 to 10 mass % of a hydroxyalkyl ether carboxylic acid salt-type surfactant can be blended from the viewpoint of foaming improvement.

In the present invention, the following components can be optionally blended as additives in addition to the above-described components so far as the above-described effect is not impaired. These optional components are disinfectants such as trichlorocarbanilide and hinokitiol; oil; perfume; pigment; chelating agents such as trisodium edetate dihydrate; UV absorbers; antioxidants; natural extracts such as dipotassium glycyrrhizinate, plantago herb extract, lecithin, saponin, aloe, phellodendron bark, and chamomile; nonionic, cationic or anionic water-soluble polymers; usability improvers such as lactic acid esters, etc.

When a chelating agent is used in the cleansing composition of the present invention, hydroxyethane diphosphonic acid and salts thereof are preferable examples, and the more preferable example is hydroxyethane diphosphonic acid. The blending quantity is preferably 0.001 to 1.0 mass %, and more preferably 0.1 to 0.5 mass %. If the blending quantity of hydroxyethane diphosphonic acid and salts thereof is less than 0.001 mass %, the chelating effect is insufficient, and unfavorable yellow discoloration etc. takes place with time. If the blending quantity is more than 1.0 mass %, the irritation to the skin becomes strong and it is not desirable.

As the production method of the soap of the present invention, general methods such as the framing method and the milling method can be applied to the above-described mixture of each component.

When transparent soap is made as the solid soap of the present invention, the soap with decreased transparency because of blended pigment etc. is also included. In this application, the term "transparent" means that arbitrarily-sized letters written on a transparent film can be made out through a soap which is put on the transparent film and is irradiated with light. Thus, a transparent soap of the invention may include various levels of translucent soap as long as it is not opaque.

Effect of the Invention

As explained above, in the soap of the present invention, wherein 50 mass % or more of medium-chain fatty acid is in the total fatty acid, adequate formability and shape-retaining property can be achieved, by the addition of betaine, while the solubility and the foaming property in cold water are maintained.

BEST MODE FOR CARRYING OUT THE INVENTION

Hereinafter, the best modes for carrying out the present invention will be described.

The present inventors have carried out the investigation by using the following basic formulation to improve the foaming property of transparent soap of the fatty acid soap series. The blending quantities are shown in mass %.

First, the present inventors attempted the production of transparent solid soap by using the soap of the basic formulation consisting of the below-described soap part, sugar/polyol part, and others.

| Basic formulation | |
|---|---|
| Fatty acid soap part | 30.0% |
| Higher fatty acid (stearic acid) | X parts |
| Medium-chain fatty acid (lauric acid:myristic acid = 1:3) Neutralized with sodium hydroxide:potassium hydroxide = 7:3 (mole ratio) | Y parts |
| Sugar/polyol par | 40.0% |
| 1,3-BG | 15.0 parts |
| PEG1500 | 2.5 parts |
| Sorbitol | 20.0 parts |
| Sucrose | 23.0 parts |
| Glycerin | 30.0 parts |
| Others | 30.0% |
| Trimethylglycine | X% |
| Sodium dodecane-1,2-diol acetate ether | 5.0% |
| Sodium N-lauroyl-N'-carboxymethyl-N'-hydroxyethylethylenediamine | 2.0% |
| PEG-60 hydrogenated castor oil | 5.0% |
| Chelating agent | 0.1% |
| Ion-exchanged water | balance |

In the following test, the foam volume and property were measured with a mixing-type foaming machine. That is, 1% aqueous soap solution (artificial hard water: 70 ppm, temperature: 25° C.) was prepared, and the height of foam and the property after stirring for 20 seconds was measured.

The solubility by rubbing was measured according to JISK-3304. That is, a test specimen (cross section: 15 mm×20 mm) of a fixed weight was placed on the surface of a film wetted by tap water that had been adjusted to 40° C. and dissolved by rubbing for 10 minutes by rotating the film. From the weights before and after dissolution by rubbing, the solubility by rubbing per fixed area was determined by the following equation.

$$\text{Solubility by rubbing} = (\text{weight before} - \text{weight after}) \times 100/3$$

The hardness was shown by the maximum stress, when a needle was pressed into a depth of 10 mm from the soap surface, measured with a rheometer (manufactured by Fudoh Kogyo Co.). The production suitability was evaluated by considering the easiness of producing a soap relative to solidification point and hardness (or viscosity).

Other evaluations were by the usual methods.

The comprehensive evaluation was carried out based mainly on the solidification point and the hardness.

For the solidification point: ×(40° C. or lower), Δ(40 to 45° C.), ○(45 to 50° C.), ◎(50° C. or higher).

For the hardness: ×(400 or lower), Δ(400 to 450), ○(450 to 500), ◎(500 or higher).

For other evaluation items, the evaluation was also taken into consideration when they were poor.

First, the present inventors fixed the percentages of the fatty acid soap part, sugar/polyol part, and others of the above-described basic formulation. Then, the ratio of higher fatty acids and medium-chain fatty acids was sequentially changed, and the verification of the addition effect of trimethylglycine was carried out.

The results are shown in Tables 1 and 2.

TABLE 1

| | Test Example | | | | |
|---|---|---|---|---|---|
| | 1-1 | 1-2 | 1-3 | 1-4 | 1-5 |
| Trimethylglycine (%) | 0 | 0 | 0 | 0 | 0 |
| Medium-chain fatty acids/total fatty acid | 0 | 0.2 | 0.5 | 0.7 | 1.0 |
| Solidification point | ○ | ○ | Δ | Δ | X |
| Appearance | ○ | ○ | ○ | ○ | ○ |
| Hardness | ○ | ○ | Δ | Δ | X |
| Production suitability | X | X | ○ | Δ | X |
| Foam volume | Δ | Δ | ○ | ○ | ○ |
| Foam property | X | Δ | ○ | ○ | ○ |
| Comprehensive evaluation | Δ | Δ | Δ | Δ | X |

Table 1 above shows the results when the fraction of medium-chain fatty acids in the total fatty acid was varied without blending trimethylglycine. As is clear from the table, when the fraction of medium-chain fatty acids was in the range of 0 to 0.2, the product hardness was very high; however, the foam volume and foam property were poor. In addition, the viscosity of molten soap at the time of production was very high; thus the production suitability is poor. On the other hand, when the fraction of medium-chain fatty acids was in the range of 0.5 to 0.7, the foam property and foam volume improved; however, the solidification point was low and the decreasing trend of hardness was prominent. Especially when the fraction exceeded 0.7, a long time was necessary, for the cooling and solidification of molten soap, because of the decrease in the solidification point, and the commercial production was practically difficult.

Accordingly, the present inventors have investigated the addition effect of trimethylglycine especially when the fraction of medium-chain fatty acids in the total fatty acid was 1 (100%).

The results are shown in Table 2 below.

TABLE 2

| | Test Example | | | | | |
|---|---|---|---|---|---|---|
| | 1-5 | 2-1 | 2-2 | 2-3 | 2-4 | 2-5 |
| Trimethylglycine (%) | 0 | 0.5 | 1.0 | 3.0 | 5.0 | 7.0 |
| Medium-chain fatty acids/total fatty acid | 1.0 | 1.0 | 1.0 | 1.0 | 1.0 | 1.0 |
| Solidification point | X | Δ | Δ | ○ | ○ | ○ |
| Appearance | ○ | ○ | ○ | ○ | ○ | Δ |
| Hardness | X | Δ | Δ | ○ | ○ | Δ |
| Production suitability | X | X | ○ | ○ | ○ | ○ |
| Foam volume | ○ | ○ | ○ | ○ | ○ | ○ |
| Foam property | ○ | ○ | ○ | ○ | ○ | ○ |
| Comprehensive evaluation | X | Δ | ○ | ○ | ○ | Δ |

The soap in Table 2 was produced only with myristic acid and lauric acid; moreover, Na/K=70/30; under the conditions, the solidification point and the hardness decrease easily. However, the solidification point and the hardness were notably improved by the addition of 1 to 5 mass % of trimethylglycine.

In the example wherein 7 mass % of trimethylglycine was blended, the solidification point and the hardness increased, and the improvement in the foam property was observed. However, crystals were generated, and the appearance as transparent soap deteriorated though basic soap functions were not affected.

Furthermore, the present inventors have prepared various solid soaps by using C12 and C14 fatty acids as the main component and conducted the evaluation with the evaluation criteria similar to the one used in the above Tables 1 and 2. The results are shown in Tables 3 to 5. With regard to the appearance, transparency was evaluated based on whether the soap meets the definition of the term "transparent." In Tables 3 to 5, each sample which was not completely transparent but translucent met the definition.

-continued

| Fatty acid soap part as listed in the table Neutralized with sodium hydroxide:potassium hydroxide = specified mole ratio. | |
|---|---|
| Sugar/polyol part | 40.0% |
| 1,3-BG | 6.0 parts |
| Polyoxypropylene (7) glyceryl ether | 4.0 parts |
| PEG1500 | 1.0 part |
| Sorbitol | 14.5 parts |
| Sucrose | 2.0 parts |
| Glycerin | 12.5 parts |
| Others | 30.0% |
| Trimethylglycine | X% |
| Sodium dodecane-1,2-diol acetate ether | 5.0% |
| Sodium N-lauroyl-N'-carboxymethyl-N'-hydroxyethylethylenediamine | 2.0% |
| PEG-60 hydrogenated castor oil | 5.0% |
| Chelating agent | 0.1% |
| Ion-exchanged water | balance |

TABLE 3

| | Test Example | | | | | |
|---|---|---|---|---|---|---|
| | 3-1 | 3-2 | 3-3 | 3-4 | 3-5 | 3-6 |
| Lauric acid | 7 | 0 | 0 | 0 | 7 | 7 |
| Myristic acid | 19 | 26 | 26 | 26 | 19 | 19 |
| Na/K | 7/3 | 7/3 | 6/4 | 6/4 | 6/4 | 6/4 |
| Trimethyl-glycine | 4.0 | 4.0 | 4.0 | 3.0 | 4.0 | 3.0 |
| Solidification point | 61.9 ◎ | 68.0 ◎ | 65.5 ◎ | 64.3 ◎ | 64.0 ◎ | 57.4 ◎ |
| Appearance | Opaque | Opaque | Opaque | Opaque | Opaque | Opaque |
| Hardness | 907 ◎ | 890 ◎ | 633 ◎ | 667 ◎ | 717 ◎ | 673 ◎ |
| Production suitability | Δ | Δ | Δ | Δ | Δ | Δ |
| Foam volume | ○ | ○ | ○ | ○ | ○ | ○ |
| Foam property | Δ | ○ | ○ | ○ | Δ | ○ |
| Comprehensive evaluation | Δ | ○ | ○ | ○ | Δ | ○ |

TABLE 4

| | Test Example | | | | | |
|---|---|---|---|---|---|---|
| | 4-1 | 4-2 | 4-3 | 4-4 | 4-5 | 4-6 |
| Lauric acid | 6.7 | 6.4 | 6.2 | 6.0 | 0 | 0 |
| Myristic acid | 18.1 | 17.5 | 16.8 | 16.2 | 23.1 | 22.2 |
| Na/K | 6/4 | 6/4 | 6/4 | 6/4 | 6/4 | 6/4 |
| Trimethylglycine | 3.0 | 3.0 | 3.0 | 3.0 | 3.0 | 3.0 |
| Solidification point | 57.3 ◎ | 54.2 ◎ | 54.0 ◎ | 52.4 ◎ | 62.1 ◎ | 61.3 ◎ |
| Appearance | Opaque | Opaque | Translucent | Translucent | Opaque | Opaque |
| Hardness | 693 ◎ | 667 ◎ | 597 ◎ | 593 ◎ | 690 ◎ | 683 ◎ |
| Production suitability | Δ | Δ | ○ | ○ | Δ | Δ |
| Foam volume | ○ | ○ | ○ | ○ | ○ | ○ |
| Foam property | Δ | ○ | ○ | ○ | Δ | ○ |
| Comprehensive evaluation | Δ | ○ | ○ | ○ | Δ | Δ |

TABLE 5

| | Test Example | | | |
|---|---|---|---|---|
| | 5-1 | 5-2 | 5-3 | 5-4 |
| Lauric acid | 5.7 | 5.5 | 5.3 | 5.0 |
| Myristic acid | 15.5 | 14.9 | 14.2 | 13.6 |
| Na/K | 6/4 | 6/4 | 6/4 | 6/4 |
| Trimethyl-glycine | 3.0 | 3.0 | 3.0 | 3.0 |
| Solidification | 48.6 | 47.2 | 46.7 | 45.1 |

TABLE 5-continued

| | Test Example | | | |
|---|---|---|---|---|
| | 5-1 | 5-2 | 5-3 | 5-4 |
| point | ○ | ○ | ○ | ○ |
| Appearance | Translucent | Translucent | Translucent | Translucent |
| Hardness | 607 | 653 | 607 | 620 |
| | ◎ | ◎ | ◎ | ◎ |
| Production suitability | ○ | ○ | ○ | ○ |
| Foam volume | ○ | ○ | ○ | ○ |
| Foam property | ○ | ○ | ○ | ○ |
| Comprehensive evaluation | ○ | ○ | ○ | ○ |

As is clear from the above Table 3 to Table 5, not only when myristic acid was used alone but also when lauric acid having a shorter fatty chain was allowed to coexist, the improvement in the solidification point and the hardness was observed.

Furthermore, the addition effect of trimethylglycine, which is characteristic of the present invention, was observed in the ranges of Na/K=80/20 to 50/50 and 1 to 8% of trimethylglycine. Especially, it was notable in the ranges of Na/K=70/30 to 50/50 and 1 to 5 mass % of trimethylglycine.

Transparent solid soap shown in the above Tables 1 to 5 was produced without virtually using ethyl alcohol at the time of production. They are the so-called alcohol-free-type, and the merit of the addition of trimethylglycine is especially large.

That is, when the so-called alcohol-type transparent solid soap is produced by the framing method in which 10 to 20% or more of ethyl alcohol is used at the time of production, molten soap is poured into a long cylindrical cooling frame, cooled, and cut after the removal of the soap material bar from the cooling frame. Then, aging is carried out over a long period of time (several days to several weeks) to remove the ethyl alcohol used at the time of production. So far as such an alcohol-type framed soap has hardness to the degree that the removal of the soap material bar from the cooling frame is possible and the cutting is possible, an increase in the hardness is observed during the subsequent aging period, and shape forming becomes possible, as necessary, after aging.

However, in the case of the above-described alcohol-free-type, there is a merit in that aging is not necessary because no ethyl alcohol is virtually used (5% or less at the most). On the other hand, the removal of the soap material bar, cutting, and shape forming are continuously carried out. Thus, the shortening of cooling time (increase in the solidification point) and the hardness (cutting, formability) are very important.

In this point, the addition effect (increase in the solidification point, increase in the hardness) of trimethylglycine, in the present invention, is especially useful.

Furthermore, the present inventors have carried out the verification of the effect for glycine, which is a related substance to trimethylglycine.

As a result, a hardening effect was somewhat observed also for glycine at a low concentration; however, there was a case in that the color of appearance turned yellow, and a strange smell also was generated during storage.

Thus, it is understood that the soap property improving effect by trimethylglycine is a unique effect that cannot be seen for other amino acids.

What is claimed is:

1. A solid soap comprising:

a fatty acid soap, and 1 to 5 mass % of trimethylglycine, wherein the content of myristic acid is 50 mass % or more in the total fatty acid of the fatty acid soap.

2. The solid soap according to claim 1, wherein a mole ratio of sodium/potassium is from 80/20 to 50/50.

3. The solid soap according to claim 1, comprising:

20 to 70 mass % of a fatty acid soap part, and 30 to 70 mass % of a sugar and polyol part, wherein no ethanol is contained in the solid soap.

4. The solid soap according to claim 3, wherein the solid soap is transparent.

5. The solid soap according to claim 2, comprising:

20 to 70 mass % of a fatty acid soap part, and 30 to 70 mass % of a sugar and polyol part, wherein the solid soap is transparent and no ethanol is contained in the solid soap.

* * * * *